United States Patent [19]

Yoshikai et al.

[11] Patent Number: 4,914,481

[45] Date of Patent: Apr. 3, 1990

[54] DEVELOPING APPARATUS

[75] Inventors: Tamio Yoshikai, Kyoto; Masato Asanuma, Nara; Masatoshi Kaneshige, Ikoma; Hideaki Hagihara, Nara, all of Japan

[73] Assignee: Sharp Kabushiki Kaisha, Osaka, Japan

[21] Appl. No.: 216,359

[22] Filed: Jul. 7, 1988

[30] Foreign Application Priority Data

Jul. 9, 1987 [JP] Japan ..... 62-173189
Aug. 25, 1987 [JP] Japan ..... 62-129475[U]
Sep. 25, 1987 [JP] Japan ..... 62-241643

[51] Int. Cl.[4] ..... G03G 15/06
[52] U.S. Cl. ..... 355/245; 355/260
[58] Field of Search ..... 355/215, 245, 260; 222/DIG. 1; 118/658, 653

[56] References Cited

U.S. PATENT DOCUMENTS 4,583,842 4/1986 Shimono et al. ..... 355/260
4,625,895 12/1986 Tsukano ..... 118/653 X
4,652,115 3/1987 Palm et al. ..... 355/14 TR

FOREIGN PATENT DOCUMENTS 0130772 7/1985 Japan ..... 355/3 DD
0116970 10/1987 Japan .

*Primary Examiner*—A. T. Grimley
*Assistant Examiner*—E. J. Pipala

[57] ABSTRACT

A developing apparatus which includes a developing section disposed to confront a recording medium for effecting development, and a device for supplying developing material to the developing section. The developing device is characterized in that there is mounted a stirring device rotatably provided in a supply passage for supplying the developing material to the developing section, and shutter plates are provided on an outer periphery of the stirring device so as to be controlled for rotation, thereby selectively closing or opening the supply passage.

6 Claims, 5 Drawing Sheets

DEVELOPING APPARATUS

BACKGROUND OF THE INVENTION

The present invention generally relates to a developing apparatus, and more particularly, to a developing apparatus for developing an electrostatic latent image formed on a recording medium as applied, for example, to an electrostatic transfer type copying machine, laser printer or the like.

Commonly, in a copying machine or the like, for the purpose of visualizing an electrostatic latent image formed on a recording medium such as a photosensitive member, into a visible image, there is provided a developing apparatus for causing toner composed of a colored pigment to adhere onto the electrostatic latent image. Particular, in some copying machines, there are provided a plurality of developing units respectively containing different colors of toner for developing the electrostatic latent image in various colors as well as in black and white by selectively using the developing units as required. By way of example, for obtaining a full colored image, developing units respectively containing toners in cyan, magenta, and yellow and further, in black depending on necessity are provided, and by developing the electrostatic latent image on the recording medium subjected to color separation through filters of respective colors with toners in various colors, such toners are overlapped on a transfer paper sheet, thereby providing a copied image in the full color.

The developing apparatus or developing unit as referred to above, is required to be controlled so that the toner does not adhere to the electrostatic latent image when the developing apparatus is not used for the development, and accordingly, it may be so arranged that a developing gap (i.e. a distance between the recording medium and the developing apparatus) is changed over so as to prevent the toner from contacting or being transported to a developing region confronting the recording medium.

However, when the developing gap is changed over in the case where the developing apparatus is not used for the development as described above, scattering takes place in the developing conditions, thus resulting in variations in the image density. In particular, if the positioning of the developing gap is not accurately determined, it becomes impossible to form normal images at all times.

Moreover, in the case where a magnetic brush developing system is employed for the developing apparatus, it is controlled, in some arrangements, as to prevent the magnetic brush from contacting the recording medium by deviating positions of the magnets constituting the developing region, but by such deviation of the magnet positions, there are cases where not only the image density is varied, but the image quality is markedly deteriorated due to adhesion of carrier particles (when a two or dual-component developing material is used) to the recording medium.

SUMMARY OF THE INVENTION

Accordingly, an essential object of the present invention is to provide a developing apparatus employing a magnetic brush developing system, which is capable of positively changing over between developing and non-developing states through proper control of a supply of developing material to a developing section forming the magnetic brush.

Another object of the present invention is to provide a developing apparatus of the above described type which is simple in construction and stable in functioning, and can be readily incorporated into various copying machines at low cost.

In accomplishing these and other objects, according to one preferred embodiment of the present invention, there is provided a developing apparatus which includes a developing section disposed to confront a recording medium for effecting development, and means for supplying developing material to the developing section, and characterized in that there are further provided a stirring means rotatably provided in a supply passage for supplying the developing material to the developing section, and a shutter means provided on an outer periphery of the stirring means so as to be controlled during rotation, thereby selectively closing or opening the supply passage.

In the developing apparatus according to the present invention having the construction as described above, by properly rotating the shutter means having an opening or slit means formed therein, the passage for supplying the developing material is brought into the closed or opened area. Accordingly, upon opening of the passage by the shutter means, the developing material is fed to the developing section for the developing process. Meanwhile, when the developing material supply passage is closed by the shutter means, feeding of the developing material is suspended, thus making it impossible to effect the developing process.

In another aspect of the present invention, there is provided a developing apparatus which includes a developing section disposed to confront a recording medium for effecting development, and means for supplying developing material to the developing section, and is characterized in that there are further provided a stirring means rotatably provided for rotation about a center axis in a supply passage for supplying the developing material to the developing section, a shutter plate means having an opening means for selectively closing or opening the supply passage and provided on an outer periphery of the stirring means for rotation about the center axis, and a change-over means for changing over the shutter plate means between the closed position and the opened position, with a closing angle of the shutter plate means about center axis being set to be larger than an opening angle of the opening means.

In the above arrangement according to the present invention, the developing material supplied to the developing section i.e. (a developing roller) is fed, after completion of the developing, onto a transport roller as the developing roller rotates and is further transported upwardly by this transport roller so as to be again fed through circulation, to the stirring means, such as a second stirring roller along a scraping plate to be described later. Thereafter, when the development for the recording medium such as a photosensitive member is completed and the developing by such developing apparatus becomes unnecessary, the shutter plate means is rotated through 90° and stopped through a spring clutch, and thus, inlet and outlet ports for the developing material supply passage are closed by the shutter plate means.

In the above case, if the opening angle and the closing angle of the shutter plate means are of the same degree, there is a possibility that scattering may take place in the stopping position of the shutter plate means after rotation due to scattering in the functioning of a clutch portion as the change-over means. When such positional scattering becomes large, flow of the developing material can not be completely stopped and it becomes impossible to cut the magnetic brush formed on the developing roller. However, according to the present invention, since the closing angle $\theta 1$ of the shutter plate means is set to be larger than the opening angle $\theta 2$ thereof, stable magnetic brush cutting may be effected even when scattering takes place in the stopping position of the shutter plate means.

In a further aspect of the present invention there is provided a developing apparatus which includes a shutter means capable of selectively closing or opening a developing material supply passage for supplying developing material to a developing roller, and seal members for sealing gaps between the shutter means and wall portions surrounding the peripheral portion of the shutter means.

In the arrangement according to the present invention as described above, by the provision of the seal members, even when gaps necessary for smooth rotation of the shutter plate means are formed between the shutter plate means and the surrounding wall portions, such gap may be positively closed by the above seal members. Accordingly, even when for example, external vibrations take place or assembling errors are present during the non-developing period in which the shutter plate means is closed, there is no possibility that the developing material leaks out of the gaps during closing of the shutter plate means, and thus, such defects as soiling in the form of lines, belts, etc. on the non-developing portion of the recording medium can be advantageously avoided.

BRIEF DESCRITION OF THE DRAWINGS

These and other objects and features of the present invention will become apparent from the following description taken in conjunction with the the preferred embodiment thereof with reference to the accompanying drawings, in which:

FIG. 3(*b*) is a cross-sectional view of a shutter plate means employed in the stirring roller of FIG. 3(*a*);

DETAILED DESCRIPTION OF THE INVENTION

Figure 2:
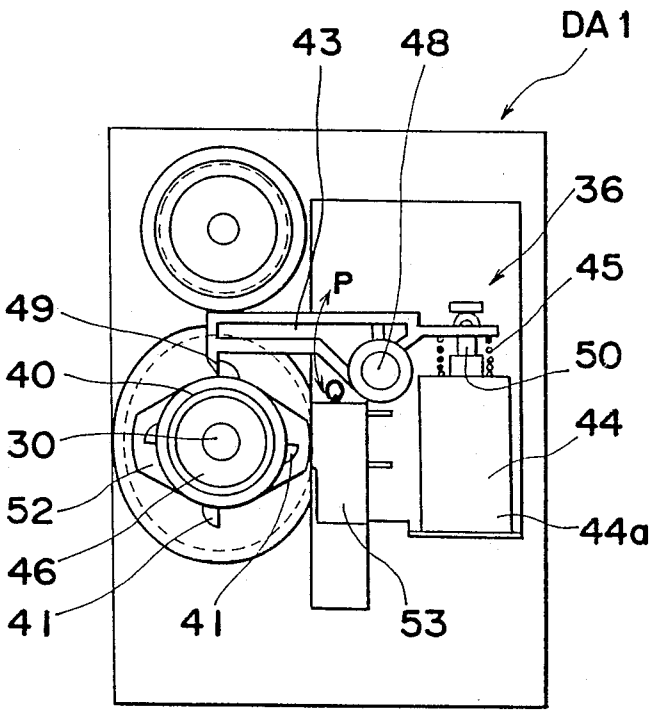
FIG. 2 is a front elevational view of a shutter plate change-over means employed in the developing apparatus of FIG. 1.

Before the description of the present invention proceeds, it is to be noted that like parts are designated by like reference numerals throughtout the accompanying drawings.

Figure 5:
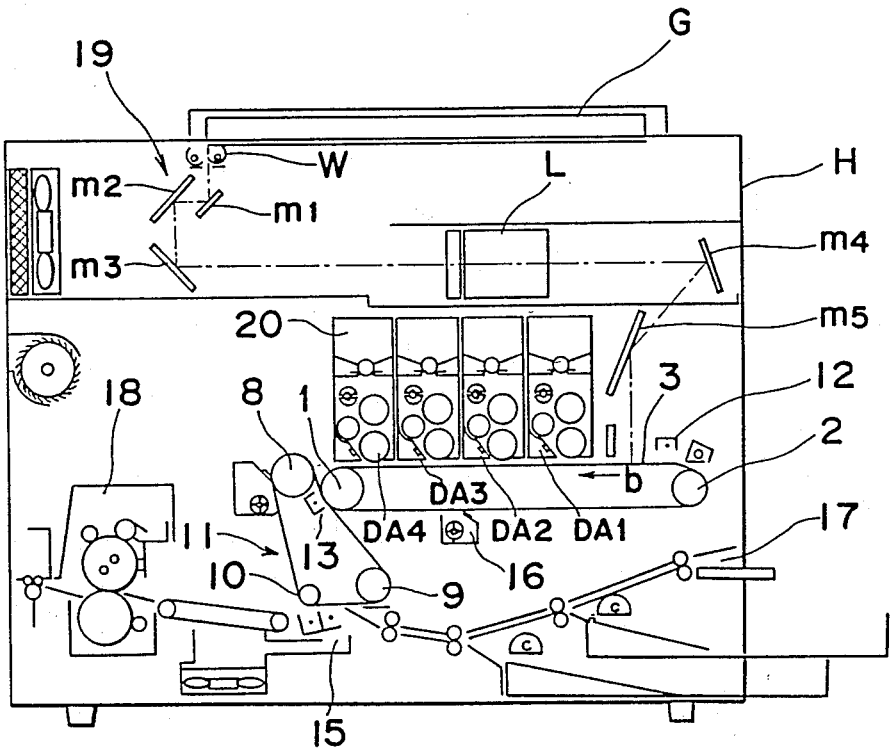
FIG. 5 is a schematic side sectional view of an electrophotographic copying apparatus to which the copying apparatus of the present invention may be applied.

Referring now to the drawings, particularly to FIGS. 1 to 5, there is shown in FIG. 5, an electrophotographic copying machine to which a developing apparatus according to one preferred embodiment of the present invention may be applied.

In FIG. 5, the copying machine generally includes a photosensitive or photoreceptor member 3 as a recording medium in the form of an endless belt movably supported by a pair of driving rollers 1 and 2 and disposed generally at a central portion of an apparatus housing H so as to be formed thereon with an electrostatic latent image of an original document (not shown) placed on a platform G of a transparent material provided at the upper portion of the apparatus housing H through an optical exposure system 19 having a light source W, reflecting mirrors m1 to m5 and a lens assembly L, and various proceeding stations such as a plurality of developing apparatuses or developing tanks DA1, DA2, DA3 and DA4 directly related to the present invention and each capable of being changed over between the developing posture and non-developing posture, and disposed above and adjacent to the upper run of the photoreceptor belt 3, an intermediate transfer member 11 in the form of an endless belt movably supported by rollers 8, 9 and 10 at the side of the driving roller 1 for contact with the photoreceptor belt 3, a main corona charger 12 disposed adjacent to the belt 3 at the side of its driving roller 2, a first transfer charger 13 provided for the intermediate transfer member 11, a second transfer charger 15 disposed under a passage for a copy paper sheet (not shown) fed to the transfer member 11 through a paper feeding device 17, and a cleaning blade 16 disposed under the photoreceptor belt 3, all of which are sequentially disposed around the photoreceptor belt 3 for electrophotographic processing. The copying machine further includes a fixing device 18 for fixing the transferred image onto the copy paper sheet in a known manner. The respective developing apparatuses or developing tanks DA1 to DA4 are provided with toner replenishing tanks 20 thereon as shown.

Since each of the developing apparatuses or developing tanks DA1 to DA4 has the same structure, the construction thereof will be explained hereinafter with reference to the developing tank DA1 as a representative.

Figure 1:
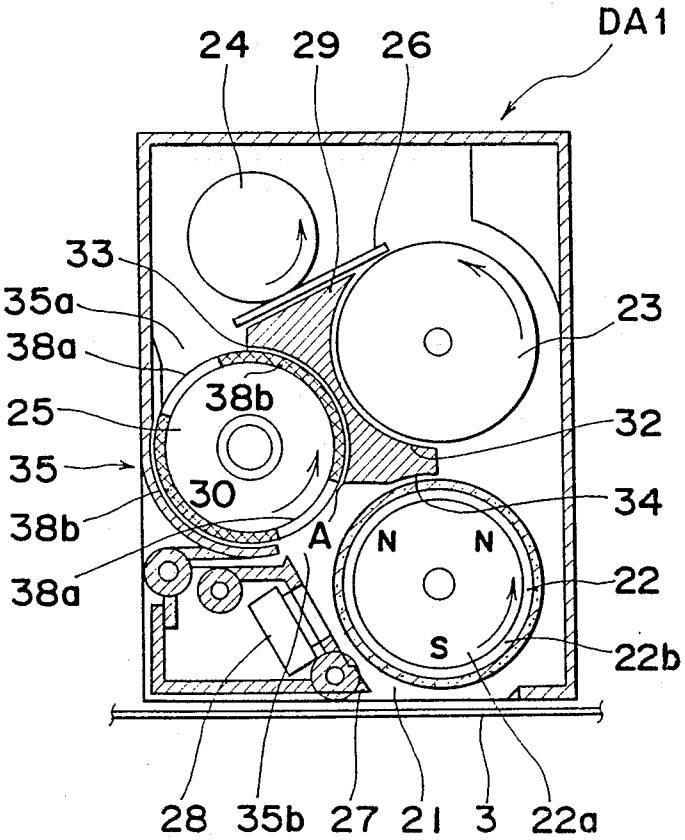
FIG. 1 is a side sectional view of a developing tank showing construction of a developing apparatus for a copying machine according to one preferred embodiment of the present invention.

As shown in FIG. 1, the developing tank DA1 includes a developing roller 22 with a developing section rotatably disposed adjacent to a toner transfer opening 21 formed at the bottom portion of the tank DA1, a developing material transport roller 23 rotatably disposed above the developing roller 22, a first stirring roller 24 for stirring the developing material scraped off the transport roller 23 by a scraper plate 26, a second stirring roller 25 for stirring the developing material from the first stirring roller 24 so as to be supplied to the developing roller 22, a doctor blade 27 spaced from the underside surface of the developing roller 22 by a predetermined distance, a toner concentration sensor 28 for detecting the concentration of the developing material, and a developing material circulation partition member 29 disposed between the developing roller 22 and the transport roller 23, and also between the first stirring roller 24 and the second stirring roller 25.

The developing roller 22 further includes a magnet member 22*a* secured to the developing tank DA1 and having at its peripheral portion, magnets magnetized in respective magnetic poles and a cylindrical non-magnetic sleeves 22*b* of aluminum material loosely fitted over the magnet member 22*a* and rotatably supported by the tank DA1, with an S pole (developing pole) of the magnet member being fixed to confront the photoreceptor belt 3. Although not particularly shown, the transport roller 23 is also constructed in a similar manner.

Figure 3A:
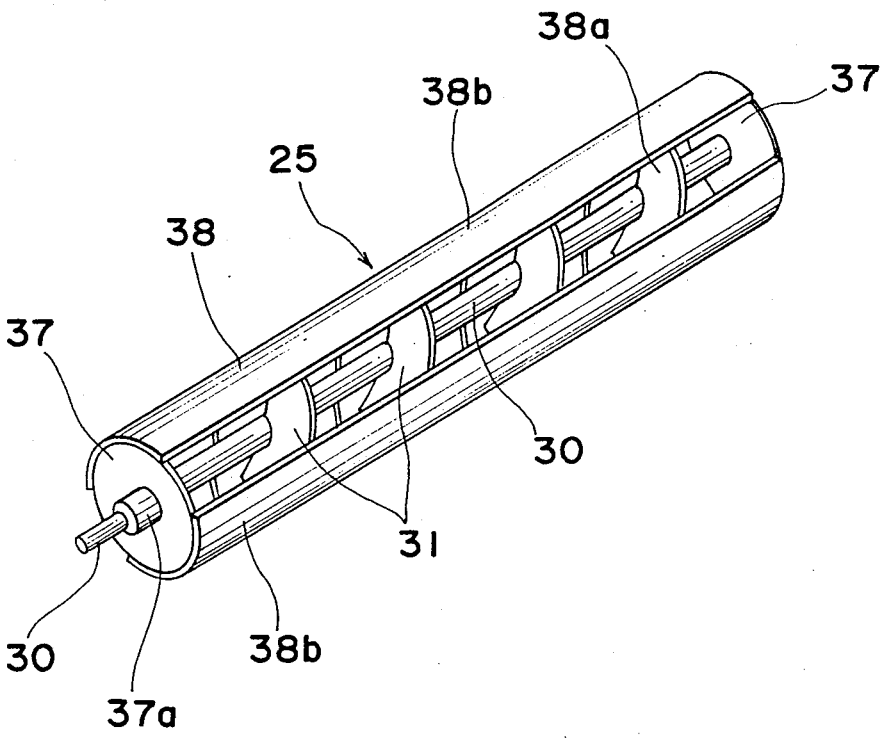
FIG. 3(*a*) is a perspective view of a second stirring roller employed in the developing apparatus of FIG. 1.
Figure 3B:
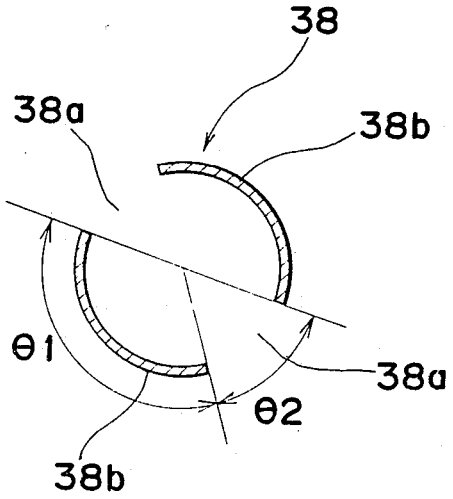
Figure 4:
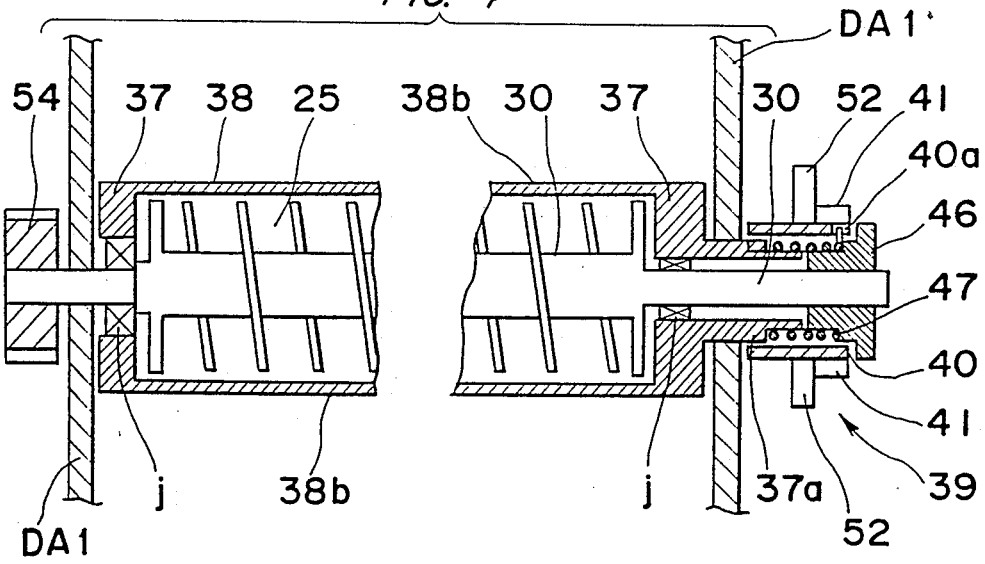
FIG. 4 is a fragmentary side sectional view of the second stirring roller showing construction of a spring clutch means.

The second stirring roller 25 includes a center shaft 30 rotatably journalled in the developing tank DA1 and a plurality of stirring fins 31 (FIG. 3(*a*)) spirally mounted on the center shaft 30. Except for a shutter plate member 38 and associated mechanisms to be described later and provided in connection with the second stirring roller 25, the first stirring roller 24 has generally the same construction as that of the second stirring roller 25, although not particularly shown.

A partition member 29 is formed into an arcuate shape at its faces 34, 32 and 33 confronting the developing roller 22, transport roller 23 and second stirring roller 25, and such arcuate faces 34, 32 and 33 confront the respective rollers 22, 23 and 25 through small clearances. However, a clearance A between the tip of each stirring fin 31 of the second stirring roller 25 and the corresponding arcuate face 33 of the partition member 29 is formed to be larger by a thickness of the shutter plate member 38, with respect to the clearances for the other rollers 22 and 23. Moreover, the wall surface of the developing tank DA1 confronting the second stirring roller 25 is also formed into an arcuate shape to provide a similar clearance therebetween.

As shown in FIG. 1, the scraper plate 26 is downwardly inclined from the side of the transport roller 23 towards the second stirring roller 25. Above the scraper plate 26, the first stirring roller 24 is rotatably provided for stirring and mixing the toner supplied from the replenishing tank 20 (FIG. 5) with the developing material. The toner accommodated in the replenishing tank 20 at the upper portion of the developing tank DA1 is supplied to the vicinity of the first stirring roller 24 according to an instruction from the developing material toner concentration sensor 28, and the developing material stirred and mixed with the toner through first stirring roller 24 is fed to the second stirring roller 25 along the scraper plate 26.

Between the first and second stirring rollers 24 and 25, a developing material inlet port 35*a* is defined by the developing tank DA1 and the partition member 29, while between the second stirring roller 25 and the developing roller 22, a developing material outlet port 35*b* is formed by the developing tank DA1 and the partition member 29, and an open/close device 35 for controlling a supply of the developing material at the side of the first stirring roller 24 to the developing roller 22 by opening or closing the inlet port 35*a* and/or outlet port 35*b*, and a change-over means 36 (FIG. 2) for changing over the open/close device 35 between the opened state and closed state are provided.

As shown in FIGS. 3(*a*) and 4, the open/close device 35 includes flanges 37 rotatably mounted, through bearing j, onto the opposite ends of the center shaft 30 of the second stirring roller 25 and the shutter plate member 38 having a pair of arcuate shutter plates 38*b* secured to the outer peripheries of the flanges 37 at the position of a point symmetry about the center shaft 30, with a set of arcuate openings 38*a* being formed between both shutter plates 38*b* as shown. As illustrated in FIG. 3(*b*), a closing angle $\theta 1$ by each shutter plate 38*b* is set to be larger than an opening angle $\theta 2$ by each opening 38*a*.

Referring also to FIG. 2, the change-over means 36 includes a spring clutch 39 provided at one end of the center shaft 30 (FIG. 4), a pivotal arm 43 releasably engaged with four claws 41 is provided at equal intervals of 90° on the outer peripheral surface of a cylindrical clutch cover 40 for the clutch 39, a solenoid 44 for forcibly rotating the pivotal arm 43 in a direction to be disengaged from the claw, and a spring 45 for urging the arm 43 in a direction to be engaged with the claws 41.

The clutch 39 includes a hub portion 46 fixed to the center shaft 30, and a coil spring 47 disposed between the hub portion 46 and a shaft portion 37*a* of the flange 37, with one end of the spring 47 being fixed in a notch 40*a* formed in the clutch cover 40 disposed around the outer periphery of the spring 47, while the other end of the spring 47 is secured to the shaft portion 37*a* of the flange 37. Although the spring 47 is wound in the direction to compress the hub portion 46, it is brought into a state spaced from the hub portion 46, i.e. into a loosened state by braking the clutch cover 40 (a rotation restricting state) so as not to transmit the rotational force of the center shaft 30.

The pivotal arm 43 pivotally supported, at its central portion, on the outer wall face of the developing tank DA1 for rotation about a shaft 48 in directions indicated by arrows P and Q is formed, at its forward end, with a stopper 49 engageable with the claws 41 of the clutch cover 40, while its rear end is connected to a plunger 50 of the solenoid 44 referred to above. The spring 45 is disposed between the rear end of the pivotal arm 43 and a main body 44*a* of a the solenoid 44.

Moreover, the clutch cover 40 is formed with projections 52 extending outwardly in a radical direction of the central shaft 30 so as to correspond in position to the shutter plates 38*b*, and a shutter plate position detecting switch 53 to be actuated by the projections 52 is provided on the developing tank DA1. At the end of the center shaft 30 opposite to its end provided with the spring clutch 39, there is fixed a driving gear 54 to which the rotational force is transmitted for rotating the second stirring roller 25 in one direction.

By the arrangement as described so far, a copying function will described hereinafter.

Upon turning ON of a copy switch (not particularly shown), the photoreceptor belt 3 is caused to move at a constant peripheral speed in a direction as indicated by an arrow b in FIG. 5, and after being uniformly charged by the main corona charger 12, the photosensitive surface of the belt 3 is subjected to exposure through the optical exposure system 19 so as to be formed with an electrostatic latent image of the original document, which is then developed into a visible toner image through contact with the magnetic brush of the developing material of the developing tank which is set to the developing posture depending on necessity. It is to be noted here that, during non-developing for the photoreceptor belt 3, the magnetic brush is not in contact with the developing roller 22 in each developing tank by the action of the open/close device 35.

The developed toner image is displaced in the direction of the arrow b as the photoreceptor belt 3 moves, and is transferred onto the intermediate transfer member 11 by the first transfer charger 13, and is further transferred by the second transfer charger 15 onto a copy paper sheet so as to be subsequently fixed thereon by a fixing device 18.

When each of the developing tanks as represented by the developing tank DA1 is to be used for the developing, it is necessary to open the passage for supplying the developing material to the developing roller 22.

Therefore, the various rollers are rotated in the directions indicated by the arrows in FIG. 1 in accordance with the rotation of the developing roller 22 (i.e. rotation of the developing sleeve). Thus, to correspond to the rotation of the second stirring roller 25, the rotational force of the center shaft 30 is transmitted to the shutter plates 38 through the spring clutch 39. In other words, the solenoid 44 is energized to pivot the arm 43 clockwise (i.e. in a direction indicated by the arrow P), whereby the forward end stopper 49 of the arm 43 is disengaged from the claw 41, and following the rotation of the center shaft 30, the spring 47 is compressed aganist the hub portion 46 of the center shaft 30, and thus, the shutter plates **38*b*** are rotated.

The solenoid 44 is kept de-energized until the pivotal arm 43 passes over one claw 41 and engages the next claw 41, so that the spring 47 is loosened by the engagement between the forward end of the arm 43 and the next claw 41, and thus, rotation of the shutter plates **38*b* is stopped. Accordingly, the shutter plates 38*b* are controlled for rotation so as to stopped through a rotation of 90°. When the shutter plates 38*b* are stopped after a rotation of 90°, the openings 38*a* between the shutter plates 38*b* confront the inlet port 35*a* and the outlet port 35*b* for the passage of the developing material, thereby opening the passage. Therefore, the developing material is supplied to the developing roller 22 while being stirred through rotation of the second stirring roller 25**, and is used for the developing process.

In this case, since the detecting portion of the toner concentration detecting sensor 28 is positioned, within the developing tank DA1, in the course through which the developing material is supplied to the developing roller 22, the toner concentration may be detected thereby, and in response to the detection output, the toner is controlled to be replenished from the replenishing tank 20 into the developing tank DA1. Meanwhile, due to the arangement wherein the projections 52 of the clutch cover 40 correspondingly depress the actuating portion of the detecting switch 53, the switch 53 notifies the control section of the copying machine main body that the shutter plates **38*b*** have open the passage, thereby establishing the developing state.

In the manner as described above, the developing material is supplied to the developing roller 22, and after completion of the developing, is fed into the transport roller 23, following rotation of the developing roller 22, so as to be transported further upwards by the roller 23, and is again supplied through circulation to the second stirring roller 25 along the scraper plate 26.

Thereafter, upon completion of the developing for the photoreceptor belt 3, when the development by such developing tank as described above becomes unnecessary, control is effected to stop the supply of the developing material. For this purpose, the solenoid 44 is energized, and is driven to the de-energized state after releasing the engagement between the forward end of the pivotal arm 43 and the claw 41, whereby, since the shutter plates **38*b* are stopped after a rotation of 90° through the spring clutch 39, the shutter plates 38*b* close the inlet port 38*a* and the output port 35*b*** for the developing material supply passage.

Accordingly, the developing material is not supplied to the developing roller 22 and the developing tank is set in the state incapable of effecting the development. Moreover, in order to inform the control section of the copying machine main body of the above state, the detecting switch 53 is in the inactuated position. In other words, by the rotation of the shutter plates **38*b* through 90°, the projections 52 are deviated from the detecting switch 53, and the actuating portion of the switch 53 is brought into a non-depressed state. In such a state, rotation of the developing roller 22 is suspended after all of the developing material attracted onto said roller 22 has been taken up by the transport roller 23**, and the developing apparatus is brought into a stand-by state ready for the next developing operation.

As described so far, although formation of the magnetic brush on the developing roller 22 is controlled by opening or closing the inlet port **35*a* and the outlet port 35*b* through rotation of the shutter plates 38*b*, scattering tends to take place in the stopping position of the shutter plates 38*b* due to state of functioning of the spring clutch 39 driving the shutter plates. In the case where the opening angle $\theta 2$ between the shutter plates 38*b* and the closing angle $\theta 1$ by the shutter plates 38*b* are of the same degree, it becomes impossible to completely stop the flow of the developing material due to the scattering of the stopping position of the shutter plates 38*b*. However, according to the present invention, it is possible to absorb the scattering in the stopping position of the shutter plates 38*b*** setting the closing angle $\theta 1$ to be larger than the opening angle $\theta 2$, and thus, stable cutting of the magnetic brush bristles may be effected at all times.

It should be noted here that the present invention is not limited in its application, to the foregoing embodiment alone, but may be modified in various ways.

By way of example, the photosensitive or photoreceptor member described in the form of an endless belt in the foregoing embodiment may be modified into a drum shape, and the number of the developing tanks need not necessarily be in plurality as shown in the embodiment, but may be only one to effect a present invention in the similar manner.

According to the developing apparatus of the present invention having constructions as described so far, since the passage is selectively opened or closed by providing the shutter plates in the passage for supplying the developing material to the developing sectional, the interval between the developing section and the recording medium is held constant at all times without variation in the developing conditions, and thus, normal images may always be formed.

Moreover, since the shutter plates are rotatably provided on the outer periphery of the stirring means, only a small space is required for the installation thus making it possible to reduce the size of the developing apparatus on the whole.

Furthermore, since the closing angle of the shutter plates is set to be larger than the opening angle, the undesirable scattering in the stopping position of the shutter plates may be absorbed for effecting stable magnetic brush cutting at all times, while positive changeover can be effected between the developing and non-developing states.

Figure 6:
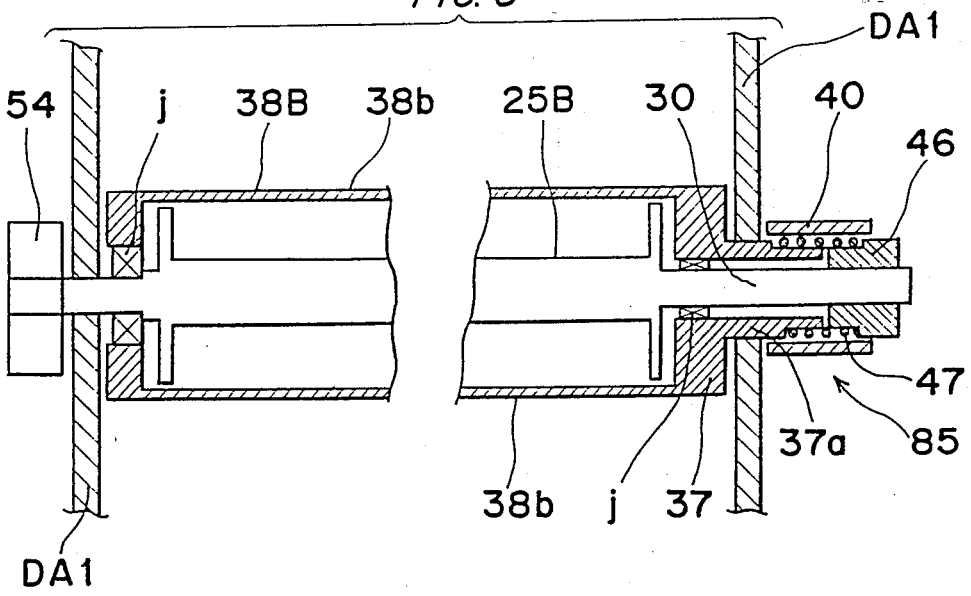
FIG. 6 is a view similar to FIG. 4, which particularly shows a modification thereof.

Referring further to FIG. 6, there is shown a fragmentary side sectional view of the second stirring roller and shutter plate member according to a modification of the first embodiment as described so far. In the subsequent description, like parts in the first embodiment are designated by like reference numerals, with the drawings for the first embodiment being referred to as necessary.

In FIG. 6, the stirring roller 25B is rotatably supported at one end of its shaft 30 by the wall of the developing tank DA1. The flange portions 37 of the shutter plate member 38B are rotatably provided with respect to the shaft 30 of the stirring roller 25B through bearing members such as ball bearings j. One end of the shutter plate member 38B such as the shaft portion 37*a* of the flange 37 is rotatably supported by the wall of the developing tank DA1 and the distal end thereof extending outwardly from the developing tank DA1 is coupled with the shaft 30 of the stirring roller 25B through a spring clutch 85. So the other end of the shaft 30 opposite to the end thereof provided with the spring clutch 85, there is fixed a driving gear 54 for transmitting rotational force so as to rotate the stirring roller in one predetermined direction.

The spring clutch 85 includes the hub portion 46 fixed to the center shaft 30, and coil spring 47 disposed between the hub portion 46 and the shaft portion 37*a* of the flange 37, with one end of the spring 47 being fixed to the clutch cover 40 disposed around the outer periphery of the spring 47, while the other end of the spring 47 is secured to the shaft portion 37*a* of the flange 37. Although the spring 47 is wound a direction to compress the hub portion 46, it is brought into a state spaced from the hub portion 46, such as a loosened state, by braking the clutch cover 40 (a rotation restricting state) so as not to transmit the rotational force of the center shaft 30 to the shutter plate member 38B.

As is seen from FIGS. 1 and 2 for the first embodiment as described earlier, the clutch cover 40 for the spring clutch 85 is integrally formed with the four claws 41 provided at intervals of 90° on its outer periphery and also, the two projections 52 for the positional detection (i.e. rotational position of the shutter plate member 38B) disposed at intervals of 180° thereon. Each of the claws 41 is positioned to correspond to one end of the pivotal arm 43 rotatably supported by the shaft 48 fixed to the developing tank DA1. The other end of the pivotal arm 43 is urged by the spring 45 disposed between the rear end of the pivotal arm 43 and the solenoid 44 so as to normally rotate the arm 43 in the counterclockwise direction, with the forward end of the arm 43 contacting the clutch cover 40. In order to turn the arm 43 clockwise against the urging force of the spring 45, the plunger 50 of the solenoid 44 is connected to the arm 43. Meanwhile, to correspond to the projections 52, the position detecting switch 53 is mounted on the developing tank 4 together with the solenoid 44, and as shown in FIG. 2, when the projection 52 depresses the actuating portion of the detecting switch 53, it is notified that the passage is opened by the openings 38*a* of the shutter plate member 38B. In FIG. 1, there is also provided the doctor blade 27 for restricting the amount of the developing material attracted onto the developing roller 22.

When the developing apparatus or developing tank having a construction as described above is to be applied to developing, it is necessary to open the passage for feeding the developing material to the developing roller 22. Therefore, the various rollers are rotated in the directions indicated by the arrows in FIG. 1 in accordance with the rotation of the developing roller 22 (i.e. rotation of the developing sleeve). Thus, to correspond to the rotation of the second stirring roller 25, the rotational force of the center shaft 30 is transmitted to the shutter plate member 38B through the spring clutch 39. In other words, the solenoid 44 is energized to pivot the arm 43 clockwise (i.e. in a direction indicated by the arrow P), whereby the forward end stopper 49 of the arm 43 is disengaged from the claw 41, and following the rotation of the center shaft 30, the spring 47 is compressed against the hub portion 46 of the center shaft 30, and thus, the shutter plates 38*b* are rotated.

The solenoid 44 is kept de-energized until the pivotal arm 43 goes over one claw 41 and engages the next claw 41, so that the spring 47 is loosened by the engagement between the forward end of the arm 43 and the next claw 41, and thus, rotation of the shutter plates 38*b* is stopped. Accordingly, the shutter plates 38*b* are controlled for rotation so as to be stopped through rotation of 90°. When the shutter plates 38*b* are stopped after a rotation of 90°, the openings 38*a* between the shutter plates 38*b* confront the inlet port 35*a* and the outlet port 35*b* for the passage of the developing material, thereby to open the passage. Therefore, the developing material is supplied to the developing roller 22 while being stirred through rotation of the second stirring roller 25, and is used for the developing operation.

In this case, since the detecting portion of the toner concentration detecting sensor 28 is positioned, within the developing tank, in the course through which the developing material is supplied to the developing roller 22, the toner concentration may be detected thereby, and in response to the detection output, the toner is controlled to be replenished from the replenishing tank 20 into the developing tank DA1. Meanwhile, due to the arrangement wherein the projections 52 of the clutch cover 40 correspondingly depress the actuating portion of the detecting switch 53, the switch 53 notifies the control section of the copying machine main body that the shutter plates 38*b* have opened the passage for establishing the developing state.

In the manners described above, the developing material is supplied to the developing roller 22, and after completion of the developing, fed into the transport roller 23, following rotation of the developing roller 22, so as to be transported further upwards by the roller 23, and is again supplied through circulation to the second stirring roller 25 along the scraper plate 26.

Thereafter, upon completion of the developing for the photoreceptor belt 3, when the development by such developing tank as described above becomes unnecessary, control is effected to stop the supply of the developing material. For this purpose, the solenoid 44 is energized, and is driven to the de-energized state after releasing the engagement between the forward end of the pivotal arm 43 and the claw 41, whereby, since the shutter plates 38*b* are stopped after a rotation of 90° through the spring clutch 39, the shutter plates 38*b* close the inlet port 35*a* and the outlet port 35*b* for the developing material supply passage.

Accordingly, the developing material is not supplied to the developing roller 22 and the developing tank is set in a state incapable of effecting the development. Moreover, in order to inform the control section of the copying machine main body of the above state, the detecting switch 53 is in inactuated position. In other words, by the rotation of the shutter plates 38b through 90°, the projections 52 are deviated from the detecting switch 53, and the actuating portion of the switch 53 is brought into a non-depressed state. In such a state, rotation of the developing roller 22 and related parts is suspended after all of the developing material attracted onto said roller 22 has been taken up by the transport roller 23, and the developing apparatus is brought into a stand-by state ready for the next developing operation.

In the above arrangement of the present invention also, due to the construction wherein the passage is selectively opened or closed by providing the shutter plates in the passage for supplying the developing material to the developing section, the interval between the developing section and the reducing medium is held constant at all times without variation in the developing conditions, and thus, normal images may always be formed. Furthermore, since the shutter plates are rotatably provided on the outer periphery of the stirring means, only a small space is required for the installation, thus making it possible to reduce the size of the developing apparatus on the whole.

Figure 7:
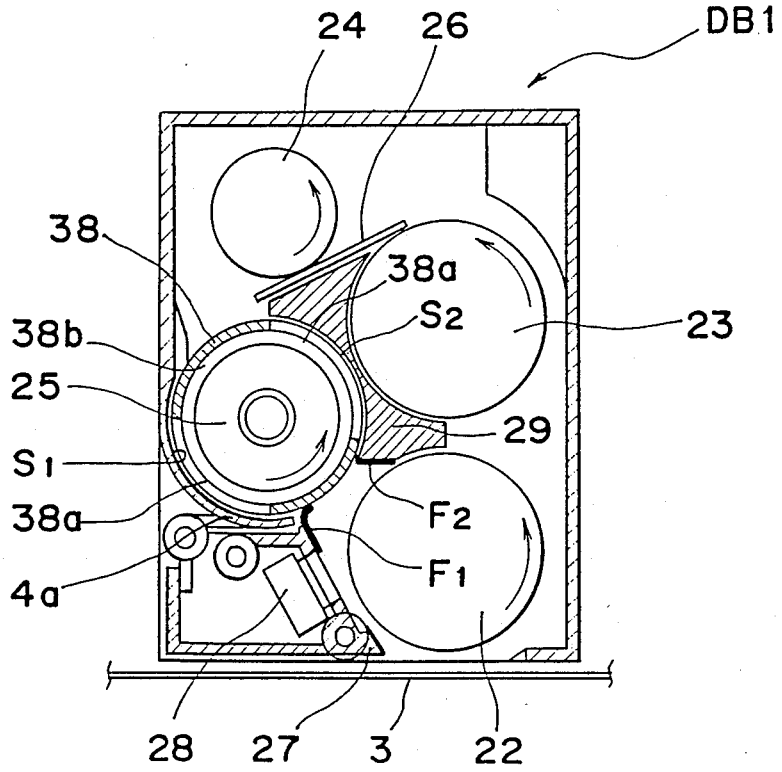
FIG. 7 is a view similar to FIG. 1, which particularly shows a modification thereof.

Referring further to FIG. 7, there is shown another modification of the arrangement of FIG. 1, in which like parts are designated by like reference numerals, with detailed description thereof being abbreviated for brevity. As shown in FIG. 7, within the developing tank DB1 in which the developing material is accommodated, there is rotatably provided the developing roller 22 which confronts the photoreceptor belt 3 for effecting developing by causing the magnetic brush formed thereon to contract the electrostatic latent image on the surface of the photoreceptor belt 3 in a manner similar to the foregoing embodiments.

During development of the electrostatic latent image, only the required developing tank of the plurality of developing tanks has its shutter plate member 38 set in the opened state to continue the supply of the developing material onto the developing roller 22, and simultaneously with completion of the electrostatic latent image on the surface of the photoreceptor belt 3, the shutter plate member 38 is rotated through an angle of about 90° as shown in FIG. 7 to close the openings 38a of the shutter plate member 38 through a curved portion 4a of the wall for the developing tank DB1 and the partition member 29, while the developing material supply passage is cut off by the wall portion constituting the shutter plate member 38, thereby suspending the supply of developing material to the developing roller 22. The developing material supply passage for supplying developing material to the developing roller 22 is defined by the partition member 29 disposed between the transport roller 23 and the stirring roller 25 for separation, and the curved wall portion 4a of the developing tank DB1.

Meanwhile, at the lower portion of the developing tank DB1, the doctor blade 27 is provided for restricting the amount of developing material attracted onto the developing roller 22 so as to define the developing material supply passage between the shutter plate member 38 and the developing roller 22. On this doctor blade 27, the toner concentration sensor 28 is also mounted to detect the toner concentration of toner.

At the upper edge of the doctor blade 27 adjacent the stirring roller 25 and the lower edge of the partition member 29 facing the roller 25, seal member F1 and F2 in the sheet form are respectively provided to contact the outer periphery of the shutter plate member 38, thereby sealing a gap S1 between the shutter plate member 38 and the curved wall portion 4a of the developing tank DB1 and also a gap S2 between the shutter plate member 38 and the partition member 29.

Each of the seal members F1 and F2 should preferably be formed of a material superior in resiliency, and in the present embodiment, a urethane rubber sheet approximately 0.1 mm in thickness is employed for the purpose. By using such seal members F1 and F2 superior in elasticity, during the closing period of the shutter plate member 38 as shown in FIG. 7, the forward edges of the seal members F1 and F2 contact the surface of the shutter plate member 38 under a proper elastic force while being deflected for securing positive sealing, and, even during functioning of the shutter plate member 38 for rotation through about 90°, the forward edges of the seal members F1 and F2 continuously slide over the outer peripheral surface of the shutter plate member 38. Meanwhile, when the shutter plate member 38 has been rotated through an angle of 90°, the opened state is established, and at this time, due to the nature of the seal members F1 and F2, seal members F1 and F2 are restored to an original state by resiliency, with the forward edges thereof slightly entering the opening 38a of the shutter plate members 38.

By the above arrangement, upon rotation of the non-magnetic sleeve of the developing roller 22 in the direction indicated by an arrow in FIG. 7, the magnetic brush of the developing material magnetically attracted onto the surface of the non-magnetic sleeve rubs against the electrostatic latent image formed on the photosensitive surface of the photoreceptor belt 3 for developing the latent image into a visible toner image.

The developing material after the developing is taken up by the developing roller 22 so as to be fed to the transport roller 23. At the transport roller 23, since its non-magnetic sleeve is rotating in the direction indicated by the arrow, the developing material is transported as it is attracted onto the surface of the sleeve, and thereafter, is scraped off the surface of the non-magnetic sleeve by the scraper plate 26.

The developing material thus scraped off by the scraper plate 26 is stirred and mixed with toner by the toner stirring roller 24 so as to be subsequently transported to the stirring section along the scraper plate 26.

At the stirring section, when the shutter plate member 38 is rotated and set in the opened state, the developing material flows into the stirring roller 25 through the opening 38a at the inlet side of the shutter plate member 38 for stirring. Then, the developing material is fed out, through the outlet side opening 38a of the shutter plate member 38, onto the developing roller 22 so as to be again applied to the developing process by the roller 22.

Subsequently, for completing the developing process, the shutter plate member 38 is rotated through an angle of about 90° to shut off the developing material supply passage. At this time, as shown in FIG. 7, since the forward edges of the seal members F1 and F2 respectively attached to the doctor blade 27 and the partition member 29 are held in sliding contact with the outer peripheral surface of the shutter plate member 38, the gap S1 between the shutter plate member 38 and the curved portion 4a of the developing tank DB1, and the gap S2 between the shutter plate member 38 and the partition member 29 are both closed, and thus, the developing material is prevented from leaking out through the gaps S1 and S2. Accordingly, since no developing material is fed to the developing roller 22 thereby, the magnetic brush is not formed on the non-magnetic sleeve of the developing roller 22, and consequently, the development for the photoreceptor belt 3 is not effected.

Figure 8:
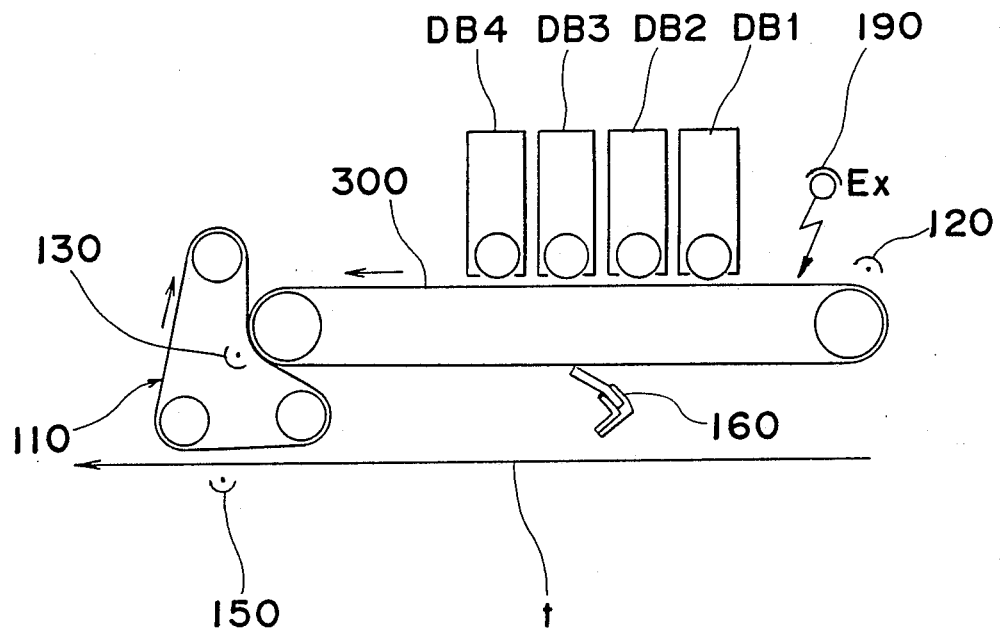
FIG. 8 is a schematic diagram showing an essential portion of a copying machine to which the developing apparatus of FIG. 7 is applied.

The developing apparatus DB as described as far is applied, for example, to an electrophotographic copying process as schematically shown in FIG. 8, with like parts in FIG. 5 being designated by like reference numerals for brevity of description.

Specifically, a plurality of developing apparatuses DB1, DB2, DB3 and DB4 each having the shutter mechanism according to the present invention (four units in FIG. 8) are disposed side by side in positions above and close to the photoreceptor belt 300 moving at a constant peripheral speed in the direction indicated by the arrow, and in order to develop the electrostatic latent image formed on the surface of the photoreceptor belt 300 in colors, the magnetic brush of the developing apparatus to be used for the developing, selected as desired from the developing apparatuses DB1 to DB4, is rubbed against the surface of the phototreceptor belt 300 for developing the electrostatic latent image into a visible image. Since the developing appparatus not used for the developing are suspended in the supply of the developing material to the developing roller by the shutter mechanism incorporated therein, no developing is effected thereby.

The photoreceptor belt 300 is first charged by the main charger 120, and after exposure by the optical exposure means 190, is subjected to developing by the developing apparatuses DB1 and DB4. The developed toner image is displaced in the direction of the arrow as the photoreceptor belt 300 moves, and then, is then transferred onto the intermediate transfer member 110 by the first transfer charger 130. The toner image thus transferred onto the intermediate transfer member 110 is further transferred onto a copy paper t fed in the direction of the arrow by the second transfer charger 150 so as to be subsequently fixed on the copy paper. For cleaning the surface of the photoreceptor belt 300, a cleaning brush 160 is provided.

As is seen from the foregoing description, the modified developing apparatus of FIG. 7 is provided with the shutter plate member capable of selectively closing or opening the developing material supply passage for supplying developing material to the developing roller, and seal members for sealing gaps between the shutter plate member and wall portions surrounding the peripheral portion of the shutter plate member.

Since the shutter plate member and the seal members for sealing the portions between the shutter plate member and the wall portions surrounding the peripheral portion of the shutter plate member are provided, even when gaps are formed between the shutter plate member and the surrounding wall portions for achieving smooth movement of the shutter plate member, such gaps may be positively closed by the shutter plate member. Accordingly, during the non-developing period in which the shutter plate member is closed, even if, for example, external vibrations take place or assembling errors occur, there is no possibility that the developing material will leak out through the gaps as referred to above during closing of the shutter plate member, and consequently, defects such as soiling in the form of lines or belts, etc. at the non-developed portion of the recording medium can be positively prevented.

Although the present invention has been fully described by way of example with reference to the accompanying drawings, it is to be noted here that various changes and modifications will be apparent to those skilled in the art from the detailed description herein. Therefore, unless otherwise such changes and modifications depart from the scope of the present invention, they should be construed as included therein.

What is claimed is:

1. A developing apparatus comprising:

a developing section disposed to confront a recording medium for effecting development;

means for supplying developing material to said developing section;

stirring means rotatably provided in a supply passage for supplying the developing material to said developing section;

transport means for transporting the developing material from said developing section to said stirring means; and shutter means provided on an outer periphery of said stirring means so as to be controlled during rotation of said stirring means, thereby selectively closing or opening said supply passage.

2. A developing apparatus as claimed in claim 1, wherein said shutter means includes a shutter plate member having a pair of arcuate shutter plates with a set of arcuate openings being formed between the pair of shutter plates.

3. A developing apparatus as claimed in claim 1, wherein said developing apparatus further comprises change over means for changing over said shutter means between a closed position and an open position.

4. A developing apparatus as claimed in claim 3, wherein said change over means comprises a transmitting means for transmitting a rotational force of said stirring means to said shutter means.

5. A developing apparatus as claimed in claim 4, wherein said transmitting means is a spring clutch.

6. A developing apparatus comprising:

a developing section disposed to confront a recording medium for effecting development;

means for supplying developing material to said developing section;

stirring means rotatably provided for rotation about a center axis in a supply passage for supplying the developing material to said developing section;

shutter plate means for selectively closing or opening said supply passage and being provided on an outer periphery of said stirring means for rotation about the center axis; and change-over means for changing over said shutter plate means between the closed position and the opened position, wherein a closing angle of said shutter plate means about said center axis is set to be larger than an opening angle of said opening means.

* * * * *